US006379481B2

(12) United States Patent
Brisberger

(10) Patent No.: US 6,379,481 B2
(45) Date of Patent: Apr. 30, 2002

(54) METHOD AND APPARATUS FOR CARRYING OUT THE ANNEALING STEP OF A GALVANNEALING PROCESS

(75) Inventor: Rolf Brisberger, Issum (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/310,831

(22) Filed: May 12, 1999

(30) Foreign Application Priority Data

May 16, 1998 (DE) ..... 198 22 156

(51) Int. Cl.[7] ..... C21D 9/60
(52) U.S. Cl. ..... 148/526; 148/533
(58) Field of Search ..... 148/527, 533

(56) References Cited

U.S. PATENT DOCUMENTS 4,079,157 A 3/1978 Yagi et al. ..... 427/380
4,287,008 A * 9/1981 Torou et al. ..... 148/533
5,409,553 A * 4/1995 Sagiyama et al. ..... 148/526
5,628,842 A * 5/1997 Wilmotte et al. ..... 148/533
6,159,622 A * 12/2000 Hori et al. ..... 148/533

FOREIGN PATENT DOCUMENTS

FR 1501271 10/1967
JP 8-165550 * 6/1996 ..... 148/533

* cited by examiner

*Primary Examiner*—George Wyszomierski
(74) *Attorney, Agent, or Firm*—Friedrich Kaeffner

(57) ABSTRACT

A method and an apparatus for carrying out the annealing step of a galvannealing process in which strips and sheets, particularly of steel, are subjected after galvanizing to an annealing step by heating the coated material and subsequently holding at final annealing temperature, wherein, during annealing, the heating step is interrupted by at least one additional holding step and, thus, a stepwise increase of the temperature over time is adjusted.

3 Claims, 2 Drawing Sheets

METHOD AND APPARATUS FOR CARRYING OUT THE ANNEALING STEP OF A GALVANNEALING PROCESS

BACKGROUND OF THE INVENTION

1. Field of the Invention

The present invention relates to a method and an apparatus for carrying out the annealing step of a galvannealing process in which strips and sheets, particularly of steel, are subjected after galvanizing to an annealing step by heating the coated material and subsequently holding at final annealing temperature.

2. Description of the Related Art

When hot-galvanized sheet or strip steel is annealed after dipping at temperatures above the melting point of zinc, the resulting product is called galvannealed sheet or strip and the process is called galvannealing, i.e., by combining the expressions "galvanizing" and "annealing".

The coating of the coated strip treated in this manner is composed only of iron/zinc compounds with about 10–12% Fe.

A conventional hot galvanizing process is carried out before the annealing step of a galvannealing process. For this purpose, the steel surface is cleaned first. Subsequently, a recrystallizing annealing of the initial material which is hot from rolling is carried out in a furnace in a protective gas atmosphere. The strip is then cooled to galvanizing temperature and is hot galvanized by means of an aluminum-containing zinc melt. Finally, the excessive zinc melt is stripped off by means of air or nitrogen.

In a steel strip whose surface has been coated in this manner the galvannealing process is completed by a subsequent annealing step in an additional furnace.

During annealing, a diffusion-controlled process takes place between the steel matrix and the zinc coating. In dependence on the temperature adjusted during annealing and the annealing time, different FeZn phases in accordance with the zinc/iron phase diagram are formed. The respective phase components determine the total iron content of the coating.

The phase composition adjusted during this annealing step is a decisive factor for the quality of the coating and the usefulness of the basic material treated by galvannealing, for example, for the later deep-drawing process in the forging press.

In conventional plants this galvannealing furnace is composed of two zones: first, the zone for inductively heating the strip and, second, the subsequent zone for holding at the desired final temperature. The holding zone is usually heated by resistance-heated or gas-fired furnace portions.

The annealing step of the galvannealing process and, thus, obtaining a defined base composition of the coating material are dependent in particular on the parameters temperature and time. These important parameters can be influenced by the plant parameters, the strip entry temperature into the zinc melt, the temperature of the zinc melt, the aluminum concentration in the zinc melt as well as the thickness of the coating. The most important variable is the basic material, i.e. the alloy composition of the steel and its condition.

Fine sheet metal treated by galvannealing is used predominantly in the automobile industry and is distinguished by a good weldability and by the fact that it can be easily varnished.

In the past, IF-steels (interstitial-free steels) have been used almost exclusively in this field as a base material for deep-drawn products, special-deep drawn products and extra-deep drawn products for a galvannealing treatment.

IF-steels are those steels which in the iron lattice do not have any interstitially dissolved atoms. The C-atoms and the N-atoms are bound by specifically adding carbonitride formers (Ti, Nb, V) to the alloy. IF-steels have no significant contents of strength-increasing elements such as P, Mn or B. On the other hand, the element Si can be added to the alloy (up to about 0.10%) for improving the adherence of the galvannealed coating.

In order to meet the requirement for a weight reduction of automobiles, increasingly thinner sheet steels are used which, however, must have the same strength properties as conventional sheet steels. This requirement can only be met by using higher-strength steels and also higher-strength IF-steels. Higher-strength IF-steels have significant portions of the above-mentioned elements. When higher-strength steels are mentioned in the following, they are intended to also include higher-strength IF-steels, BH-steels and TRIP-steels.

However, the two steel groups IF-steels and higher-strength steels have in relation to the applied zinc coating a significantly different alloying behavior, particularly with respect to their speed. The alloy formation takes place in the higher-strength steels substantially slower than in the IF-steels.

SUMMARY OF THE INVENTION

Therefore, it is the primary object of the present invention to propose a method and an apparatus for the annealing step of a galvannealing process to which sheets and steels of different base materials, particularly of higher-strength steels can be subjected without negatively affecting the output.

In accordance with the present invention, during annealing, the heating step is interrupted by at least one additional holding step and, thus, a stepwise increase of the temperature over time is adjusted.

The apparatus according to the present invention for carrying out the annealing step of a galvannealing process includes a zone for inductively heating the strip and an additional zone for holding the strip at final temperature, wherein the zone for inductively heating the strip is interrupted by at least one additional holding zone.

The basic concept of the present invention is the adjustment of the annealing cycle with respect to the parameters temperature and time to the base materials, particularly higher-strength steels, for taking into consideration the material-specific alloying progress. The proposed process technology including the stepwise annealing treatment provides the possibility of a controlled adjustment of the properties between the base material and the coating material and the coating material itself.

This annealing treatment is advantageously carried out in such a way that the heating process with subsequent holding at final temperature is interrupted by a second holding process at a temperature below the final temperature.

A furnace suitable for the apparatus according to the present invention includes a zone for inductively heating the strip and an additional zone for holding the strip at the heating temperature, wherein at least one additional holding zone is provided between the zone for inductively heating the strip and the final holding zone.

In accordance with an advantageous embodiment which is particularly suitable for higher-strength steel strips, this furnace is composed of four zones, namely, a first induction zone with a subsequent first holding zone, and a second subsequent induction zone with a subsequent second holding zone.

The proposed method for the annealing treatment carried out step-by-step or in stages in a galvannealing process and the proposed configuration of the annealing furnace have the following advantages.

By carrying out the increase of the temperature in a stepwise manner, an adjustment of the annealing treatment to the slower diffusion processes and, thus, alloying speeds in higher-strength steels is achieved. The alloying process can be controlled and regulated. This makes possible a uniform product quality under controllable production conditions. This stepwise heating process does not exhibit any disadvantages in IF-steels.

The annealing parameters, particularly the heating temperature and heating speed, are adapted to the alloying sequence of the combination steel/coating material. Consequently, overheating in the coating material does not take place without an alloy formation. Moreover, the possibility of an increased evaporation of zinc is reduced. This constitutes a significant advantage for the operation of the galvannealing furnace as well as for the morphology of the galvannealed coating.

For avoiding an overheating of the zinc coating in conventional galvannealing furnaces, which have only one single heating zone composed of several or only one single induction coil, and for adjusting a controlled alloying process, the capacity of the induction zone would have to be lowered. In order to still be able to reach the desired galvannealing temperature, this would make it necessary to reduce the speed of the plant. However, this would result in a reduction of the output of the hot galvanizing plant.

In contrast, the method and apparatus proposed in accordance with the present invention do not result in a decrease of the output of the hot galvanizing plant.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
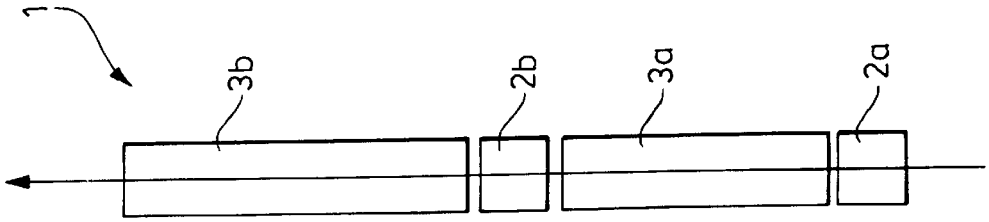
FIG. 1 is a schematic illustration of an embodiment of the furnace configuration according to the present invention for carrying out an annealing step during a galvannealing process.

The configuration of the galvannealing furnace according to the present invention with an interrupted heating zone is schematically illustrated in FIG. 1. The galvannealing furnace 1 includes a first zone 2*a* for carrying out an inductive heating step. This first zone is followed by a holding zone 3*a*. Following this holding zone 3*a*, the strip is once again conducted through a heating zone 2*b*. Subsequently, the coated strip is held at final temperature in a second holding zone 3*b*.

Figure 3:
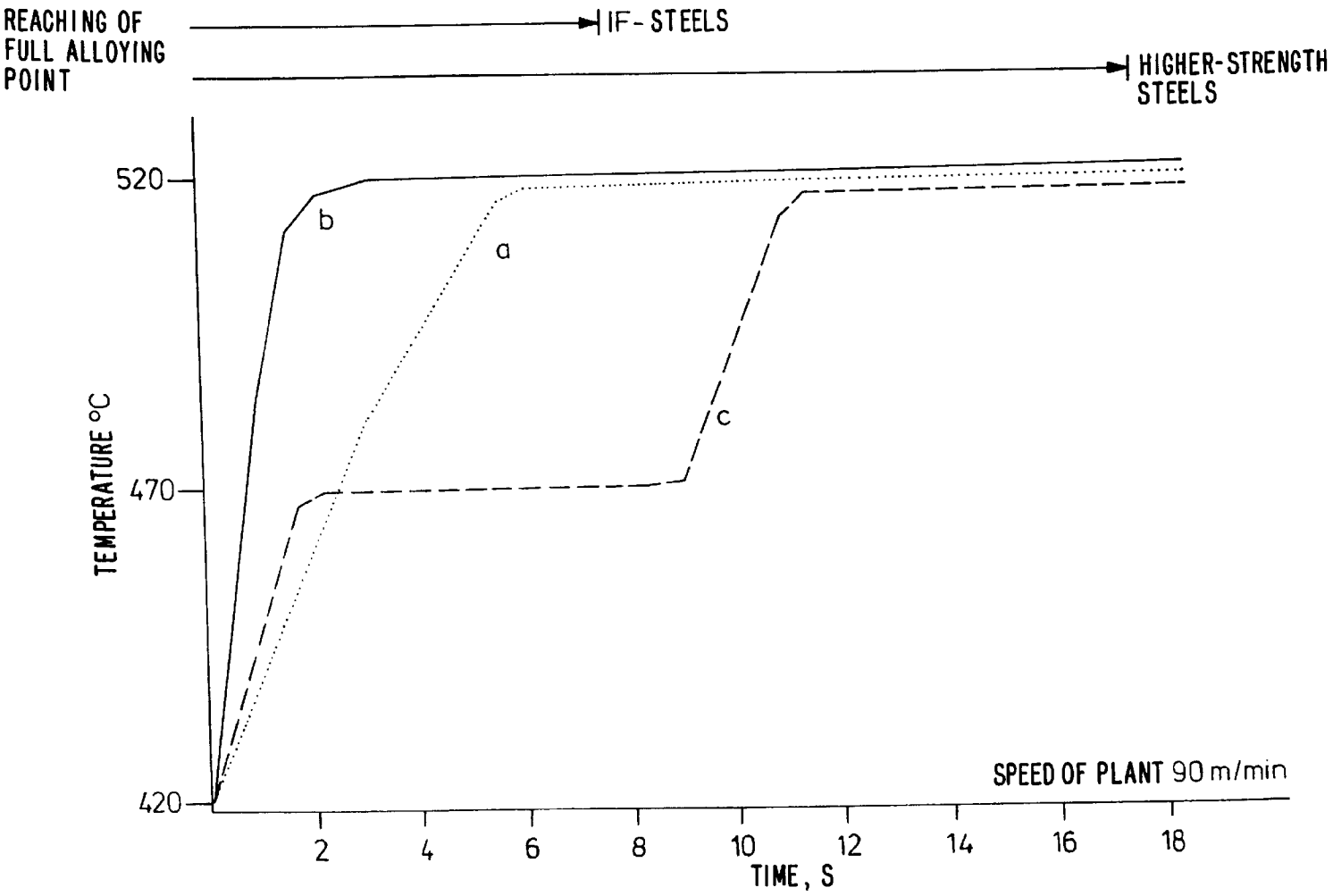
FIG. 3 is a diagram showing the strip temperature pattern over time in the different embodiments of galvannealing furnaces shown in FIG. 1 and FIGS. 2*a* and 2*b*.

The diagram of FIG. 3 shows in a broken line (curve c) the stepwise heating curve resulting from the furnace configuration according to the present invention. The speed of the plant is 90 m/min. The strip enters the furnace with an initial temperature of 420 °C. and is quickly heated in a first stage to 470 °C. The strip then enters the first holding zone 3*a* and is held for 7 s at the intermediate temperature. Subsequently, a second heating process to the final annealing temperature of 520° C. takes place.

Figure 2B:
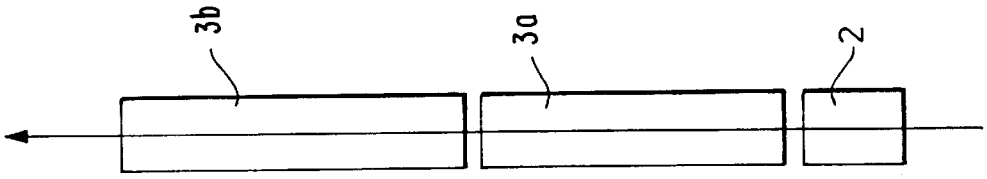
FIG.2B PRIOR ART
FIGS. 2*a* and 2*b* are schematic illustrations of conventional furnaces for carrying out an annealing step during a galvannealing process.
Figure 2A:
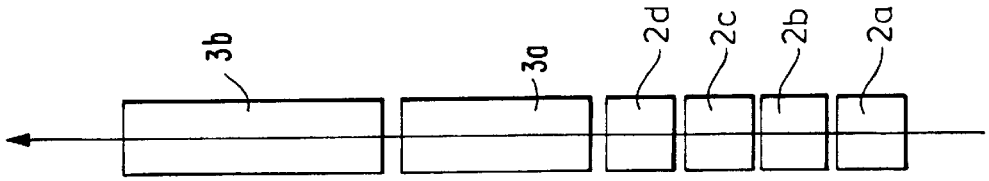
FIG.2A PRIOR ART

FIGS. 2*a* and 2*b* schematically illustrate the configurations of conventional galvannealing furnaces. Both embodiments are composed of a first zone 2 for inductively heating and a second subsequent zone composed of individual zones 3*a* and 3*b* for holding the strip at final temperature. Conventional plants with inductive strip heating are provided in the inductive section 2 either with several induction coils 2*a*, 2*b*, 2*c*, 2*d*, as a rule four to seven coils, as shown in FIG. 2*a*, or they have only a single induction coil 2, as shown in FIG. 2*b*. This single coil 2 has the same installed output as the several coils previously used together. The difference is the substantially smaller strip surface area in the inductor, so that the specific output or output density is significantly increased which, in turn, results in a higher heating rate.

The temperature/time curves of the annealing treatments carried out in the furnace embodiments of FIGS. 2*a* and 2*b* are also illustrated in FIG. 3. In contrast to the furnace according to the present invention, the final annealing temperature is reached quickly. This is advantageous for IF-steels whose full alloying point is reached already after a short time.

In higher-strength steels the alloying point is reached only after a longer annealing which is also due to the higher alloying contents in the steel. In order to prevent an overheating of the coating and to adjust a controlled alloying sequence between the base material and the coating material and in the coating material itself, an intermediate annealing step is carried out and heating to final annealing temperature is carried out subsequently. Moreover, the possibility of evaporation of zinc in the galvannealing furnace is reduced.

While specific embodiments of the invention have been shown and described in detail to illustrate the inventive principles, it will be understood that the invention may be embodied otherwise without departing from such principles.

I claim:

1. In a method of carrying out an annealing stage of a galvannealing process in which, after being coated with zinc by a hot galvanizing process, strip or sheet material of high strength steel or interstitial-free steel is annealed by carrying out a stepwise heating of the coated material, wherein the coated material is subsequently held at final end temperature, wherein the improvement comprises carrying out a first rapid heating step of the coated material, carrying out at least one additional holding step having a longer duration than the first heating step, and subsequently carrying out a second rapid heating step, carrying out the heating steps inductively, and carrying out the holding step by resistor-heating or gas heating.

2. The method according to claim 1, wherein the at least one additional holding step is carried out at a temperature below the final annealing temperature.

3. The method according to claim 1, wherein the first and second heating steps have a duration of about two seconds and the additional holding step has a duration of about seven seconds.

* * * * *